US006630678B2

(12) United States Patent
Guzorek

(10) Patent No.: US 6,630,678 B2
(45) Date of Patent: Oct. 7, 2003

(54) ULTRAVIOLET AIR PURIFYING APPARATUS

(75) Inventor: Steve Guzorek, Kinston, NC (US)

(73) Assignee: Field Controls, L.L.C., Kinston, NC (US)

( * ) Notice: Subject to any disclaimer, the term of this patent is extended or adjusted under 35 U.S.C. 154(b) by 341 days.

(21) Appl. No.: 09/767,998

(22) Filed: Jan. 23, 2001

(65) Prior Publication Data

US 2002/0104972 A1 Aug. 8, 2002

(51) Int. Cl.[7] ..... G21G 4/00; G01N 21/00

(52) U.S. Cl. ..... 250/432 R; 250/435; 250/436; 250/493.1

(58) Field of Search ..... 250/432 R, 435, 250/436, 504 R, 493.1; 422/121

(56) References Cited

U.S. PATENT DOCUMENTS 3,877,152 A * 4/1975 Gorman ..... 34/43
3,924,139 A * 12/1975 Hirose et al. ..... 250/527
4,367,410 A * 1/1983 Wood ..... 250/431
4,786,812 A * 11/1988 Humphreys ..... 250/455.1
4,931,654 A * 6/1990 Horng et al. ..... 250/435
5,316,673 A * 5/1994 Kohlmann et al. ..... 250/435
5,660,719 A * 8/1997 Kurtz et al. ..... 250/436
5,866,076 A * 2/1999 Fencl et al. ..... 422/121
6,372,186 B1 * 4/2002 Fencl et al. ..... 422/121

* cited by examiner

*Primary Examiner*—Bruce Anderson
(74) *Attorney, Agent, or Firm*—McDermott, Will & Emery

(57) ABSTRACT

An ultraviolet device used for flooding an air duct of an air ventilation system with ultraviolet light comprising a mounting portion, the mounting portion that is mountable to an air duct, at least one mounting bracket which is interchangeably mountable to the mounting portion and at least one ultraviolet light lamp, the lamp is mountable to the mounting bracket wherein the angle at which the lamp mounts to said mounting bracket may be configured to maximize the coverage of ultraviolet light within the air duct.

17 Claims, 10 Drawing Sheets

ULTRAVIOLET AIR PURIFYING APPARATUS

FIELD OF THE INVENTION.

The present invention relates generally to an ultraviolet device used for flooding an air ventilation system with ultraviolet light to control growth of or kill contaminants in the air passing through a ventilation system. Specifically, the present invention relates to an ultraviolet device used for flooding an air duct with ultraviolet light to control growth of or kill contaminants in the air passing through the duct, wherein the device may include one or more ultraviolet lights, mounted at an angle within the cross-sectional area of the duct, to maximize the coverage of ultraviolet therein.

BACKGROUND OF THE INVENTION.

It has long been known to use heating, ventilation and air conditioning systems ("HVAC") to provide ventilation to enclosed structures. HVAC usually comprises one or more blowers connected to a circuit of ventilation ducts to control the amount and direction of airflow throughout the structure. While some fresh air will usually be introduced into the system, much of the air within the enclosed structure is recycled through the system. HVAC is also typically employed, as the name suggests, to control the air temperature of the enclosed environment by controlling the temperature of the air directed therein.

The introduction of cool air into an HVAC system will often lower the temperature of the warmer air within the ventilation ducts forcing the warmer air to release portions of the humidity therein. Similarly, when cool air has cooled the temperature of the ventilation ducts and warmer air is then introduced into the ventilation ducts, humidity from the warmer air may condense onto the cool ventilation ducts. Also, the humidity from warm air passing over a chiller used to cool the air circulating through the HVAC will likewise condense on the chiller. In any case, HVAC systems are prone to having moisture therein.

The dark and damp conditions within the ducts of an HVAC system are conducive to the rapid growth and reproduction of contaminants such as molds, spores, bacteria, viruses and mildews which may be harmful to the people for whom the air traveling therethrough is intended. HVAC systems thus become a breeding ground for these contaminants. Inhabitants may suffer adverse physical reactions as a result, especially if they are allergic to any of the contaminants. This problem is exacerbated when the inhabitants themselves introduce additional contaminants into the HVAC system that may then multiply in the contaminant friendly HVAC environment and spread to other inhabitants located within the structure. Air filters have been introduced into HVAC systems in an attempt to remove contaminants passing therethrough before they reach inhabitants. However, these filters often become damp themselves and provide conditions which foster growth and reproduction of the contaminants.

It is known that light of the "C" band of the ultraviolet spectrum, with wavelengths between approximately 220 and 288 nanometers, ("UV light") can control growth of or kill most contaminants currently known to exist within HVAC systems. The longer the period of time a unit of air is exposed to UV light, and the greater the density of the UV light that a unit of air is exposed to, the greater the number of contaminants within the unit of light will be killed thereby. Lamps capable of emitting UV light typically comprise a long, hollow cylinder containing one or more gasses therein that will, upon being excited by electric current, emit UV light. These UV lamps primarily radiate UV light in a direction perpendicular to the surface from which the light emanates. Therefore, UV light emits radially from tubular lamps. In other words, UV light is only emitted in directions perpendicular to the length of the UV light tube. Additionally, the intensity of the UV light emitted at any point measured radially from the lamp is inversely related to the radial distance as measured from the tubular UV light source.

The intensity of UV light emitted from UV lamps is commonly measured in microWatts. Longer UV lamps generally emit a greater intensity of UV light than shorter lamps. For example, a twelve inch UV lamp may produce 37 micro Watts at one meter from the lamp, an eighteen inch UV lamp may produce 73 micro Watts at one meter from the lamp, and a twenty-eight inch UV lamp may produce 133 micro Watts at one meter from the lamp. Therefore, in order to increase the intensity of UV light within an air duct and maximize the effectiveness of the UV device, it is desirable to employ the longest lamp that will fit within a given duct size.

Known configurations of UV lamps in HVAC systems fail to provide a sufficient amount of UV light to control growth of or kill the desired amount of contaminants. Accordingly it would be desirable to employ a device that can increase the effectiveness of a tubular UV lamp used to control or kill contaminants within an HVAC system.

SUMMARY OF THE INVENTION

It is one of the principal objectives of the present invention to provide an air treatment or purification device capable of efficiently controlling or killing contaminants within an HVAC system.

It is another objective of the present invention to provide a device including one or more UV light emitting lamps to flood UV light over a large volume of air within a standard HVAC air duct.

It is yet another objective of the present invention to provide a device including one or more standard UV light emitting lamps to flood UV light over a large cross-sectional area of air within a standard HVAC air duct.

It is still another objective of the present invention to provide an ultraviolet device that can be mounted within an HVAC air duct that only requires access to one side of the air duct for mounting the device.

It is a further objective of the present invention to provide a device that has a removable bracket that allows the UV lamp to be mounted within the HVAC air duct at different angles to optimize the light coverage within the duct.

These and other objectives of the present invention will become apparent upon examining the drawings and figures together with the accompanying written description thereof.

DETAILED DESCRIPTION OF THE DRAWINGS

Figure 1:
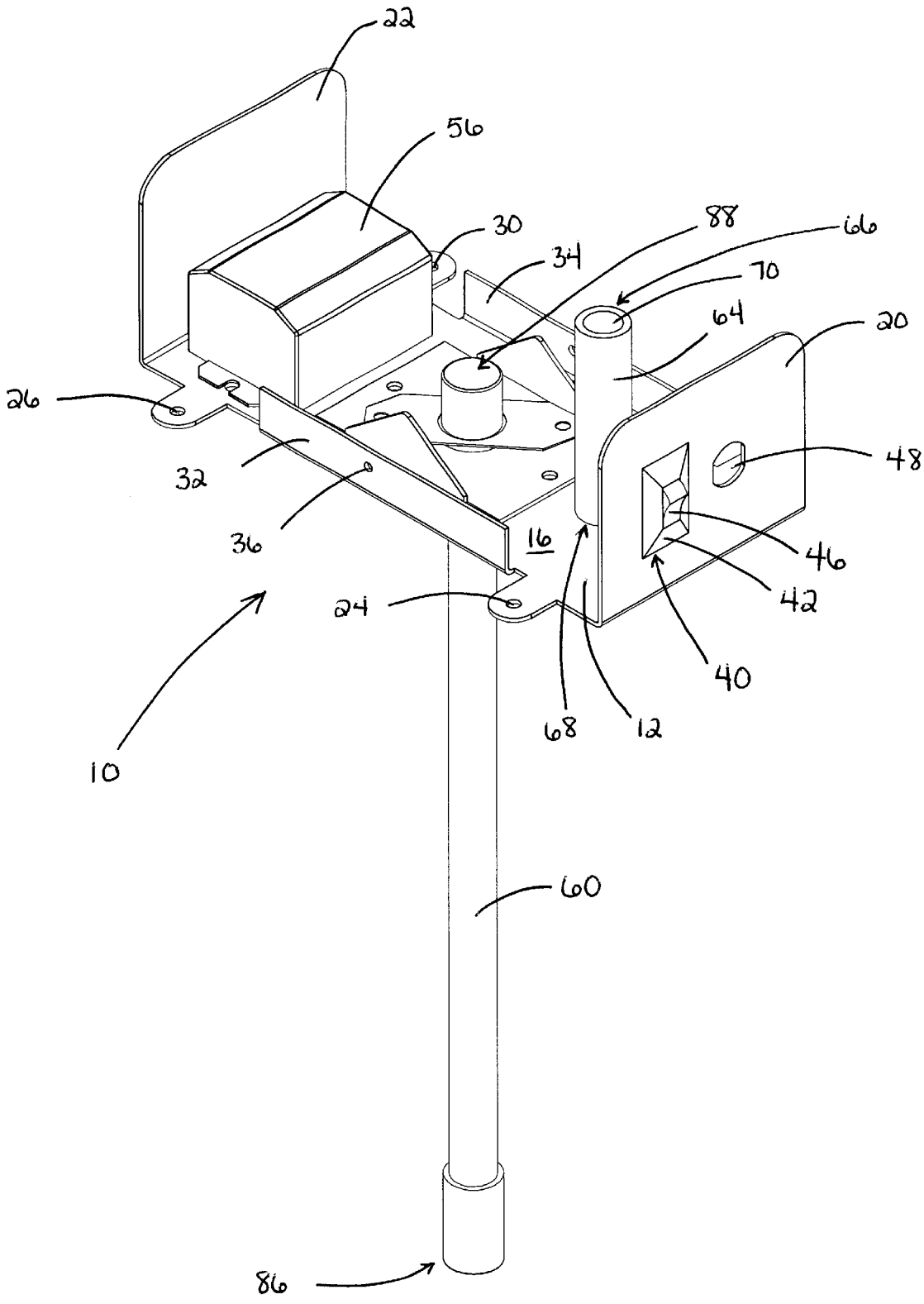
FIG. 1 is a perspective view of the UV device, shown without a cover, and a straight-mounted UV lamp.

FIG. 1 depicts one embodiment of the UV device 10 of the present invention. As shown in FIG. 1, the UV device 10 has a housing 12 for mounting the device 10 to an air duct 14 (FIGS. 6, 7, 8, and 9). The housing 12 has an interior surface 16 and an exterior surface 18 (FIG. 5). Additionally, the device 10 has a bottom portion 20 and a top portion 22 integrally formed with the housing 12. The housing 12 includes four mounting holes 24, 26, 28, and 30 (FIG. 4) for mounting the device 10 to the air duct 14 using bolts, screws, or any other appropriate fasteners. The configuration of the mounting holes 24, 26, 28, and 30 can be adjusted to accommodate other mounting methods and devices. A left side flange 32 and a right side flange 34 are integrally formed with the housing 12. Each of the side flanges 32 and 34 includes a hole 36 for attaching a cover 38 (FIGS. 2 and 3) to the device using bolts, screws, or any other appropriate fasteners.

The housing 12, bottom portion 20, top portion 22, side flanges 32 and 34, and cover 38 are preferably formed of coated steel, such as a stainless or carbon steel. Alternately, the housing 12, bottom portion 20, top portion 22, side flanges 32 and 34, and cover 38 can be formed of any material that is sufficiently strong to support the UV device 10 when mounted to an air duct 14, inhibits the transmission of UV light, and withstand the temperatures of an HVAC duct. For example, some injection molded plastics with UV inhibitors may be able to provide adequate support, prevent UV light from escaping the air duct 14, and withstand the temperatures of an HVAC duct 14.

Figure 4:
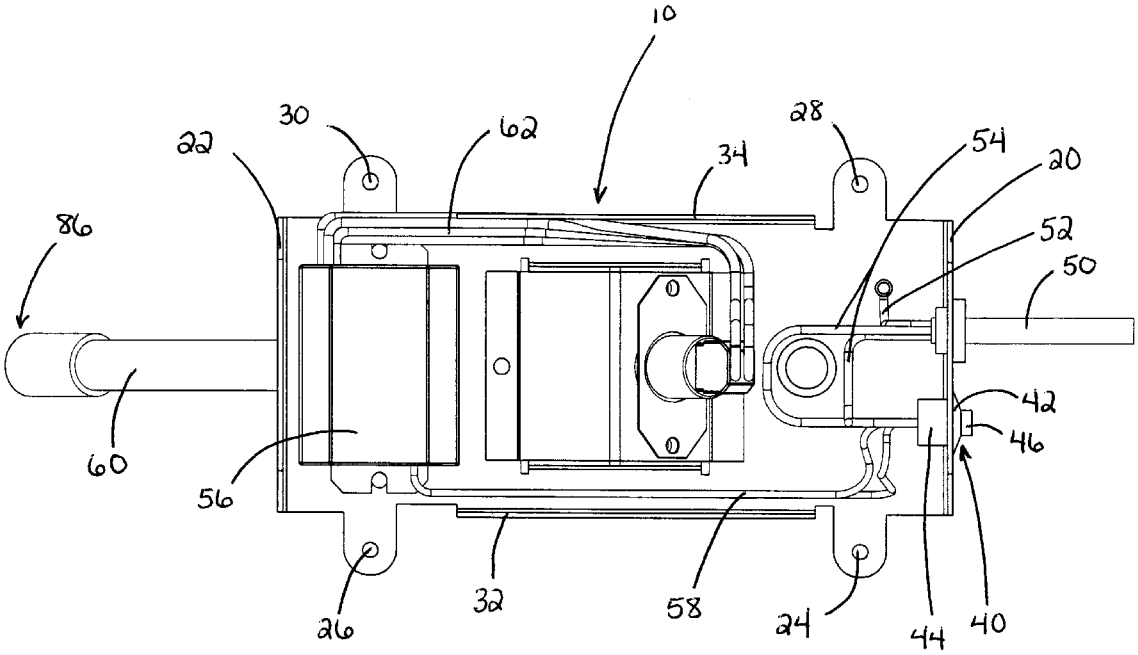
FIG. 4 is a top view of the device, shown without the cover, including the wiring configuration and an angularly-mounted UV lamp.
Figure 5:
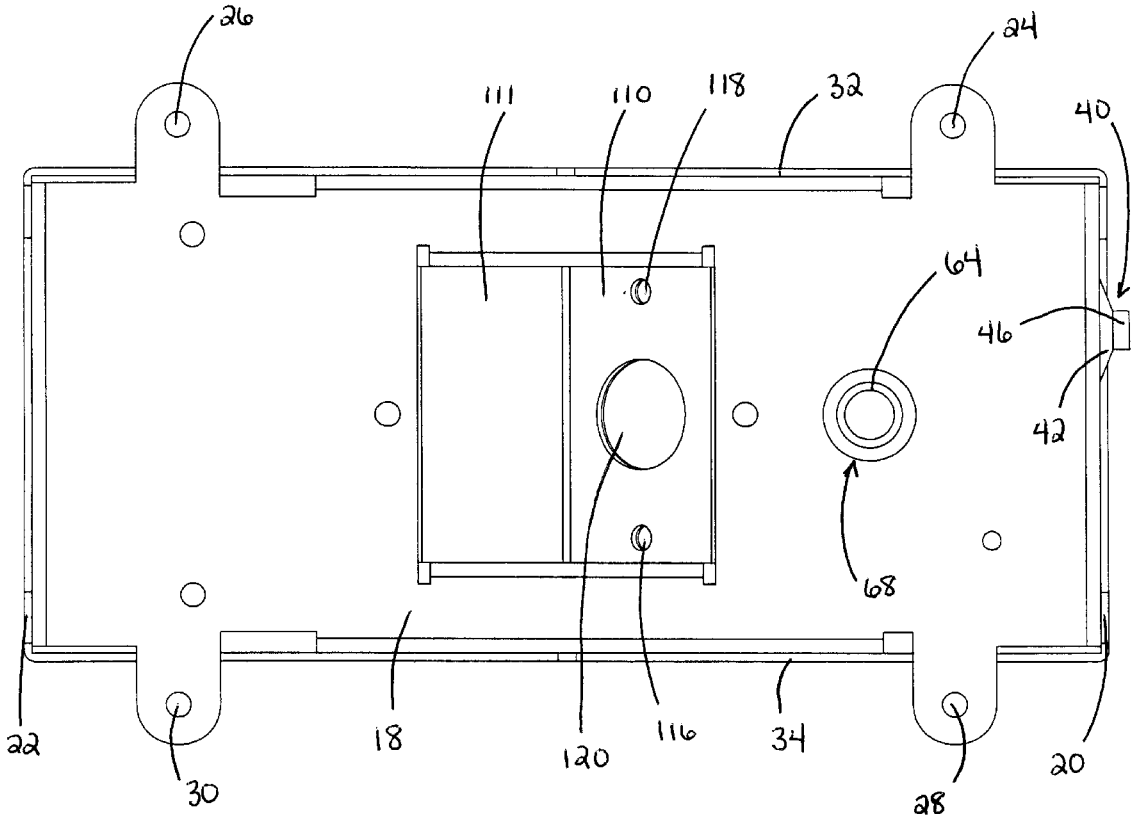
FIG. 5 is a bottom view of the device.

Now looking at FIG. 4, an electrical power assembly 40 is mounted through a hole (not shown) in the bottom portion 20 of the device 10. The power assembly 40 has an outer end 42 and an inner end 44. When the power assembly 40 is properly mounted through the bottom portion 20 of the device 10, the outer end 42 of the power assembly 40 faces the exterior of the device 10 while the inner end 44 of the power assembly 40 faces the interior of the device 10. The outer end 42 includes a switch 46 and the inner end 44 includes connections (not shown) for electrical wires. Additionally, there is a hole 48 (FIG. 1) for mounting a standard alternating current ("AC") cord 50, including a ground wire 52 and two AC wires 54, through the bottom portion 20 of the device 10. The ground wire 52 attaches to the interior surface 16 of the housing 12 of the device 10 using a bolt or similar attaching means. The AC wires 54 attach to the connections in the inner end 44 of the power assembly 40.

A ballast 56 is bolted to the interior surface 16 of the housing 12 of the device 10. The ballast 56 connects to the power assembly 40 using a second pair of AC wires 58. The power assembly 40 operates to control the flow of current from the AC cord 50 to the ballast 56. The ballast 56 transforms the AC current carried by the second pair of AC wires 58 into an electrical current appropriate for powering a germicidal UV lamp 60. The ballast 56 can be a Robertson Worldwide (Blue Island, Ill.) ballast appropriately matched to the particular UV lamp 60 being implemented in the device 10 or another ballast 56 appropriate for powering the UV lamp 60. The UV lamp 60 can be a standard germicidal UV lamp 60 such as a Light Sources (Orange, CN) UV lamp 60 or another germicidal UV lamp 60. It is important that the ballast 56 and the UV lamp 60 are appropriately matched because each UV lamp 60 requires a particular ballast 56 for proper operation. A third set of electrical wires 62 transfer transformed current between the ballast 56 and the UV lamp 60.

Looking back to FIG. 1, an elongated, hollow, viewing piece 64, having a first end 66 and a second end 68, is attached through the housing 12 of the device 10. A lens 70 is mounted to the first end 66 of the viewing piece 64 to decrease the amount of UV light transmitting through the first end 66 of the viewing piece 64. The lens 70 allows an operator to look through the viewing piece 64 into the interior of the air duct 14 to which the device 10 is mounted to verify the UV lamp 60 is operating properly. The viewing piece 64 is preferably formed of coated steel, such as a stainless or carbon steel, however the viewing piece 64 may be constructed of another material so long as the material allows the viewing piece 64 to provide an operator a view of the interior of the air duct 14. The lens 70 is preferably constructed of glass or plastic, however the lens 70 may be constructed of another material so long as the material permits an operator to view the interior of the air duct 14, while at the same time reduces the amount of UV light transmitting through the first end 66 of the viewing piece 64 to a level that is safe for operation by an operator.

Figure 2:
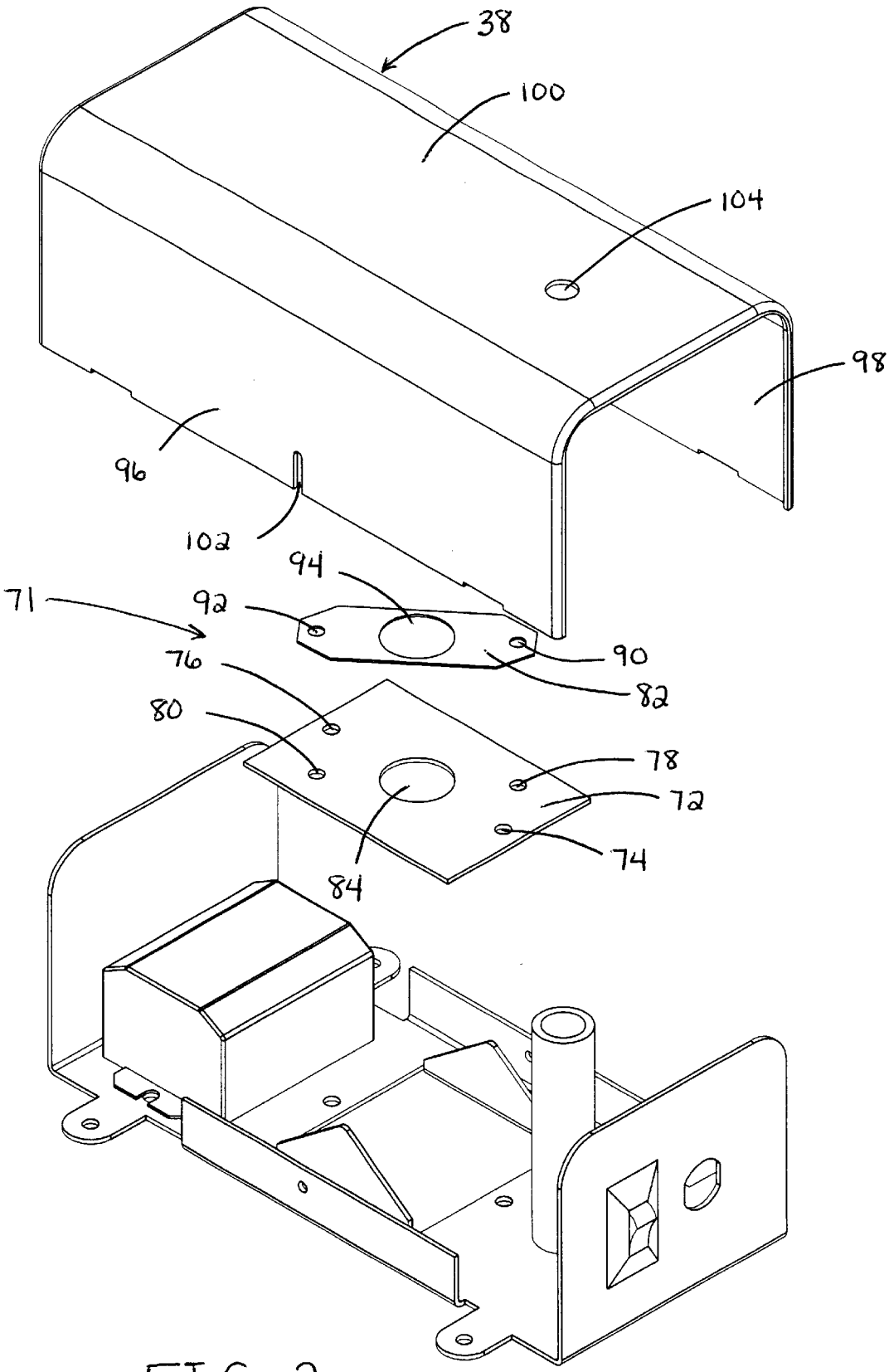
FIG. 2 is an exploded perspective view of the UV device shown with a straight mounting piece.

The UV lamp 60 is secured to the housing 12 by a mounting bracket assembly 71, which includes a mounting bracket 72 and a clamping piece 82. As shown in FIG. 2, a straight mounting bracket 72 can be mounted to the interior surface 16 of the housing 12 of the device 10. The straight mounting bracket 72 includes two mounting holes 74 and 76 for mounting the straight mounting bracket 72 to the device 10 using two bolts or similar attaching means. Additionally, the straight mounting bracket 72 includes two mounting holes 78 and 80 for attaching the clamping piece 82 to the straight mounting bracket 72. The straight mounting bracket 72 also includes a hole 84 through which a standard UV lamp 60 may extend when properly mounted to the straight mounting bracket 72. The standard UV lamp 60 has a first end 86 and a second end 88. A mounting portion (not shown) including a shoulder (not shown) is located near the second end 88 of the UV lamp 60. The clamping piece 82 includes two mounting holes 90 and 92 and a hole 94 through which the UV lamp 60 can be mounted. To mount the UV lamp 60 to the straight mounting bracket 72, an operator slides the first end 86 of the UV lamp 60 through the hole 84 in the straight mounting bracket 72 until the shoulder of the mounting portion of the UV lamp 60 prevents the UV lamp 60 from continuing through the straight mounting bracket 72. The operator then attaches the clamping piece 82 to the straight mounting bracket 72, thereby clamping the shoulder of the UV lamp 60 between the clamping piece 82 and the straight mounting bracket 72. The clamping piece 82 can be mounted to the straight mounting bracket 72 using wing-nuts, or other attaching means that enable an operator to easily mount and dismount an UV lamp 60 for repair or replacement.

As shown in FIG. 2, a cover 38 attaches to the side flanges 32 and 34 of the device 10. The cover 38 includes a left portion 96 a right portion 98 and a top portion 100. The cover 38 additionally includes two mounting slots 102, one mounting slot 102 on the left portion 96 of the cover 38 and a second mounting slot 102 on the right portion 98 of the cover 38. Each mounting slot 102 can be aligned with the hole 36 in each of the side flanges 32 and 34 such that the cover 38 can be bolted to the side flanges 32 and 34. The cover 38 also includes a viewing hole 104 that, when the device 10 is properly assembled, is located above the viewing piece 64. The viewing hole 104 operates in conjunction with the viewing piece 64 to allow an operator to look into the air duct 14 to determine if the device 10 is functioning properly.

Figure 3:
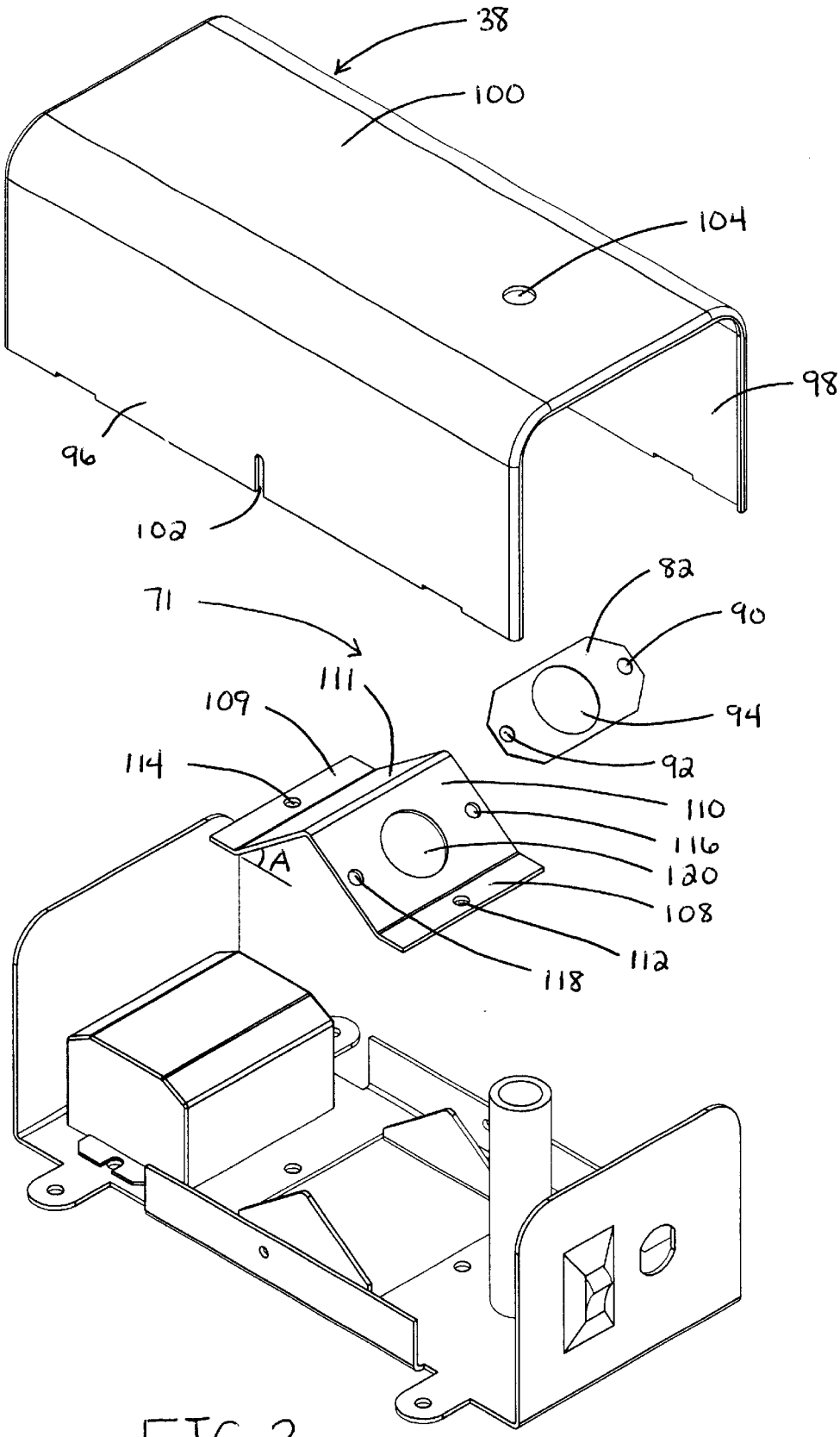
FIG. 3 is a second exploded perspective view of the UV device shown with an angled mounting piece.

Alternatively, as shown in FIG. 3, the straight mounting bracket 72 can be removed and an angled mounting bracket 106 can be mounted to the interior surface 16 of the housing 12 of the device 10. The angled mounting bracket 106 includes two mounting portions 108 and 109 and two angled portions 110 and 111. Each mounting portion 108 and 109 includes a mounting hole 110 and 112 for mounting the angled mounting bracket 106 to the device 10 using bolts or similar attaching means. The angled portions 110 and 111 of the angled mounting bracket 106 are each configured at an angle A relative to the mounting portions 108 and 109 of the angled mounting bracket 106. In FIG. 3, angle A is approximately 37 degrees. However, since angle A determines the angle at which a UV lamp 60 is mounted into the air duct 14, angle A should be adjusted to promote the appropriate UV lamp 60 installation as discussed below. The angled portion 110 also includes two mounting holes 116 and 118 used to attach the clamping piece 82 to the angled mounting bracket 106 as described above in relation to the straight mounting bracket 72. Additionally, the angled portion 110 includes a hole 120 through which the UV lamp 60 can be mounted. The clamping piece 82 can be mounted to the angled mounting bracket 106 using wing-nuts, or other means that enable an operator to easily mount and dismount a UV lamp 60 for repair or replacement.

The removable mounting brackets 72 and 106 and clamping piece 82 are preferably formed of coated steel, such as a stainless or carbon steel. However, the mounting brackets 72 and 106 and clamping piece 82 can be formed of another material so long as the material is strong enough to support the UV lamp 60 that is mounted in the UV device 10.

Figure 6:
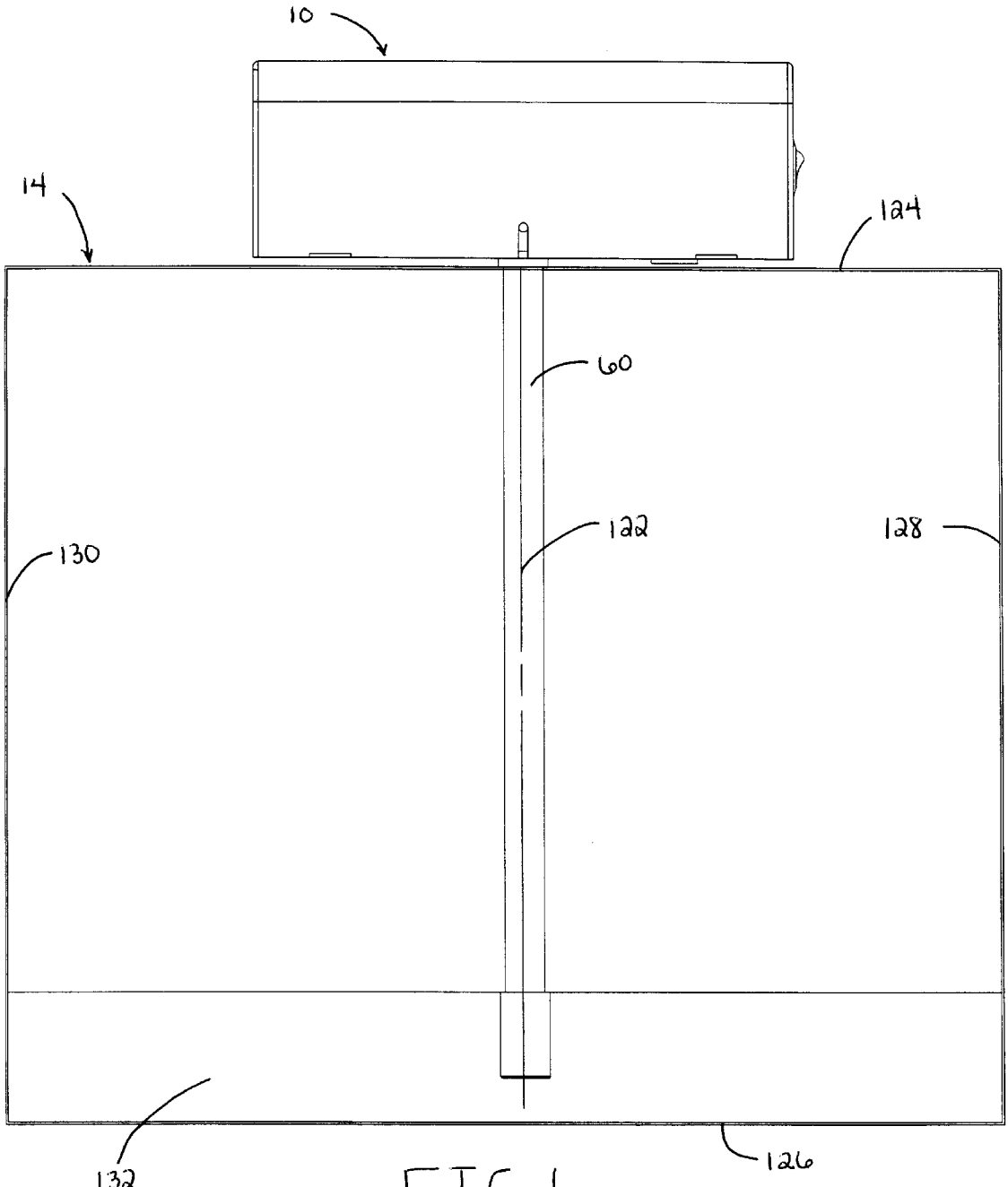
FIG. 6 is a side view of the device with a straight-mounted UV lamp mounted to an air duct as seen looking down the duct with airflow into the page.

FIG. 6 illustrates an embodiment of device 10 incorporating the straight mounting bracket 72 mounted to an air duct 14, as seen looking down the duct 14. As shown, the device 10 employs the standard tubular UV lamp 60 described above to flood UV light over a substantial cross-sectional area and volume of the air duct 14. The UV lamp 60 comprises a cylindrical tube having gas sealed therein and having a longitudinal axis 122 along the cylindrical axis thereof. The air duct 14 comprises a left side 124, a right side 126, an upper side 128, and a lower side 130. In FIG. 6, the UV lamp 60 is mounted such that the longitudinal axis 122 of the UV lamp 60 is substantially perpendicular to the left side 124 of the air duct 14 to which the device 10 is mounted. Because a UV lamp 60 only emits UV light in directions perpendicular to the UV lamp's 60 surface, the UV lamp 60 only emits light in a circular band extending radially outward from the longitudinal axis 122 of the UV lamp 60. Thus, as illustrated in FIG. 6, the UV lamp 60 creates a cylinder of UV light around the UV lamp 60 for the length of the tubular UV lamp 60. As a result, a rectangular area 132 within the air duct 14 between the first end 86 of the UV lamp 60 and the right side 126 of the duct 14 will not be flooded in UV light. Accordingly, the embodiment of the device 10 shown in FIG. 6 is more effective when the rectangular area 132 is minimized. Thus, the embodiment of the device 10 shown in FIG. 6 is most desirable when the length of the UV lamp 60 employed in the device 10 closely matches the width of the air duct 14 within which the UV lamp 60 is mounted.

Figure 7:
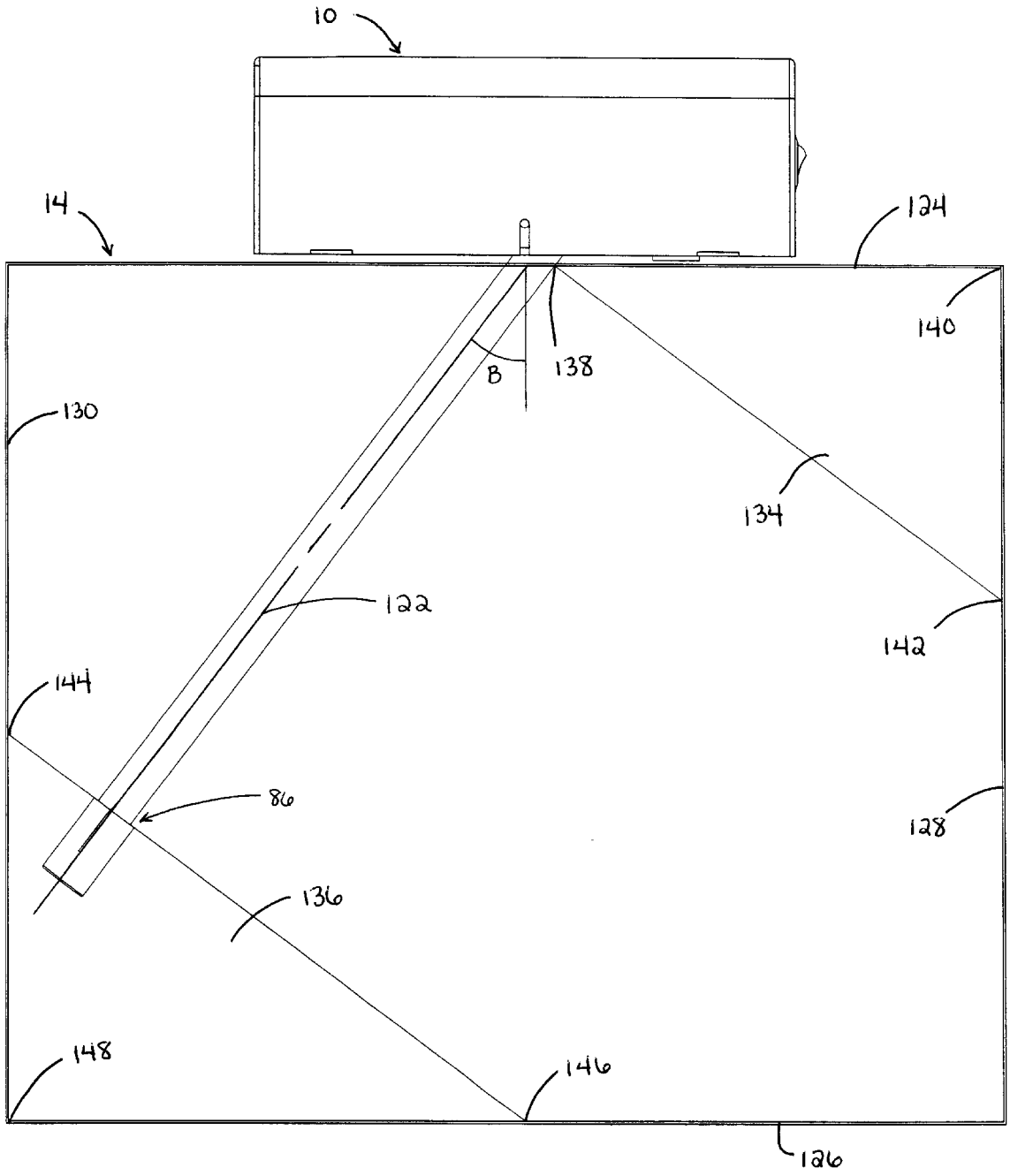
FIG. 7 is a side view of the device with an angularly-mounted UV lamp mounted to an air duct as seen looking down the duct with airflow into the page.

FIG. 7 illustrates an embodiment of the device 10 incorporating the angled mounting bracket 106 mounted to an air duct 14, as seen looking down the duct 14. As in FIG. 6, the device 10 employs the standard UV lamp 60 to flood UV light over a substantial cross-sectional area and volume of the air duct 14. The device 10 is mounted such that the longitudinal axis 122 of the UV lamp 60 forms an angle B neither substantially parallel nor substantially perpendicular to a horizontal centerline drawn through the air duct 14. As shown in FIG. 7, angle B is declined approximately 37 degrees with respect to a horizontal centerline drawn through the air duct 14. However, other angles are contemplated and will be recognized by one of ordinary skill in the art to be consistent with the invention as described herein. Specifically, the angle B should comport to the configuration of the duct 14 into which the UV lamp 60 is being mounted. Other angles can be used to obtain different coverage areas, so long as the angle used allows the device 10 to be mounted to the side of the air duct 14. For example, when utilizing the device 10 incorporating the angled mounting bracket 106 in a rectangular duct (not shown), rather than the square duct 14 illustrated in FIG. 7, the angle B can be altered to orient the longitudinal axis 122 of the UV lamp 60 into a comer of the rectangular duct, or otherwise, as necessary to increase the area of coverage of UV light within the duct 14.

As described above, because the UV lamp 60 only emits UV light in directions perpendicular to the lamp's 60 surface, the standard UV lamp 60 only emits light in a circular band extending radially outward from the longitudinal axis 122 of the UV lamp 60. Thus, as illustrated in FIG. 7, the UV lamp 60 creates a cylinder of UV light around the tubular UV lamp 60 for the length of the lamp 60. As a result, as shown in FIG. 7, two cross-sectional triangular areas 134 and 136 within the duct 14 will not be flooded in UV light. An upper triangular area 134 is defined within the duct 14 by three points 138, 140, and 142. The first point 138 is located at the intersection of the UV lamp 60 and the left side 124 of the duct 14. The second point 140 is located at the intersection of the left side 124 and upper side 128 of the duct 14. The third point 142 is located at the point along the upper side 128 of the duct 14 that is intersected by a line, drawn perpendicular to the longitudinal axis 122 of the UV lamp 60, originating from the intersection of the UV lamp 60 and the left side 124 of the duct 14. A second triangular area 136 is defined within the duct 14 by an additional three points 144, 146, and 148. The first point 144 is located at the point along the lower side 130 of the duct 14 that is intersected by a line, drawn perpendicular to the longitudinal axis 122 of the UV lamp 60, originating from the first end 86 of the UV lamp 60. The second point 146 is located at the point along the right side 126 of the duct 14 that is intersected by a line, drawn perpendicular to the longitudinal axis 122 of the UV lamp 60, originating from the first end 86 of the UV lamp 60. The third point 148 is located at the intersection of the right side 126 and lower side 130 of the duct 14. Accordingly, the effectiveness of the embodiment of the device 10 shown in FIG. 7 is influenced by the size and shape of the air duct 14, the angle B of the UV lamp 60, the distance the UV lamp 60 is mounted from the upper side 128 of the duct 14 as measured along the left side 124 of the duct 14, and the length of the UV lamp 60. The embodiment of the device 10 shown in FIG. 6 is most desirable when the length of the standard UV lamp 60 employed allows the UV lamp 60 to be mounted closer to the upper side 128 of the duct 14, to extend the longitudinal axis 122 of the UV lamp 60 closer to the intersection of the right side 126 and lower side 130 of the duct 14, and be mounted at an angle B that minimizes the area of triangles 134 and 136.

Figure 8:
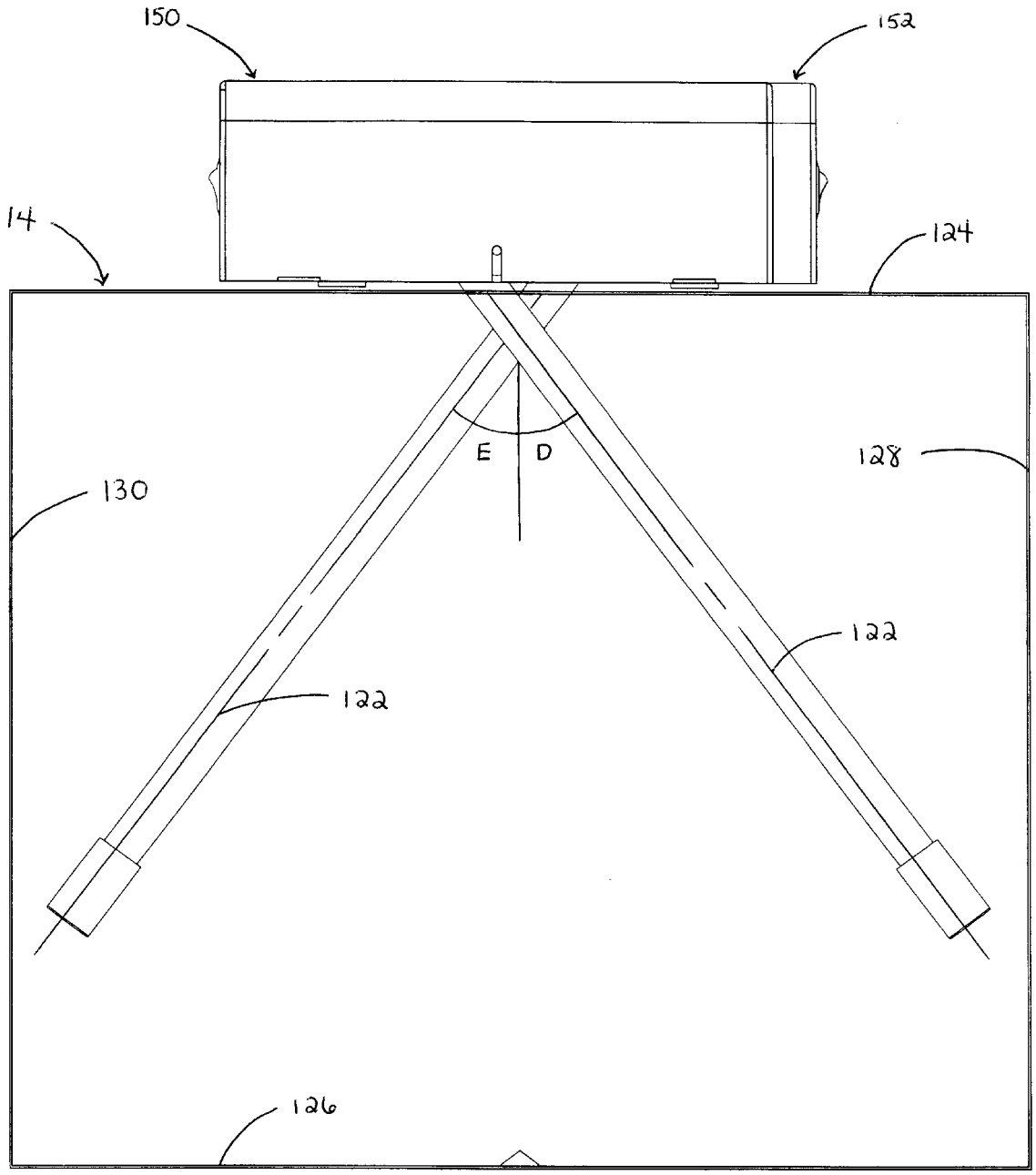
FIG. 8 is a side view of two devices with an angularly-mounted UV lamps mounted to an air duct as seen looking down the duct with airflow into the page.
Figure 9:
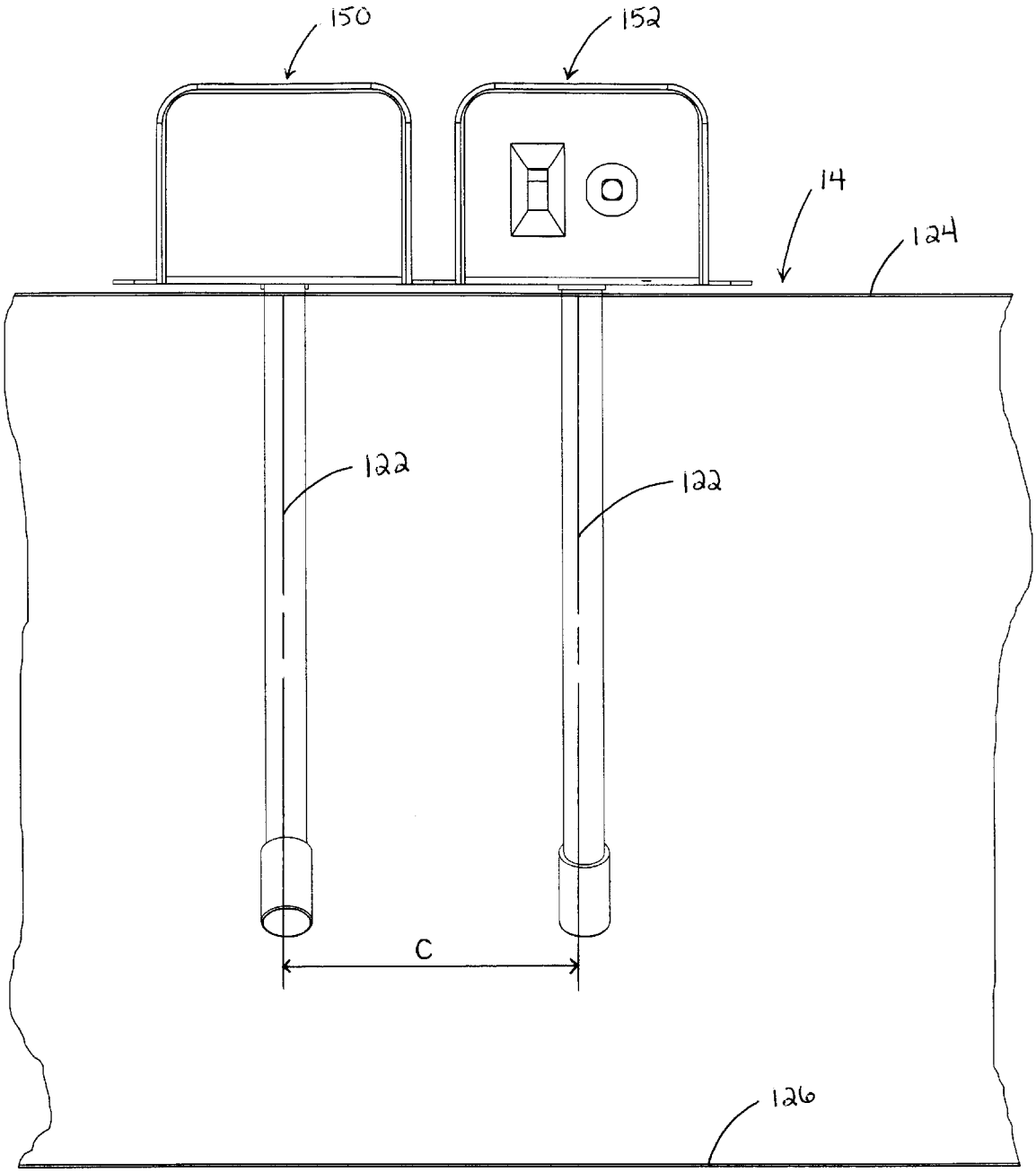
FIG. 9 is a top view of two devices with angularly-mounted UV lamps mounted to an air duct as seen with air flow from left to right.

FIGS. 8 and 9 illustrate an embodiment of the present invention using two devices 10, each incorporating the angled mounting bracket 106. FIG. 8 illustrates the embodiment as seen looking down the length of the duct 14 with airflow into the page. FIG. 9 illustrates the embodiment as seen from above the duct, with airflow from left to right. In this embodiment, a first device 150 is mounted a distance C upstream of a second device 152. Distance C should be at least approximately four inches for optimum effectiveness As shown in FIG. 8, the two devices 150 and 152 are mounted such that the longitudinal axis 122 of the UV lamp 60 of the first device 150 crosses the longitudinal axis 122 of the UV lamp 60 of the second device 152 to alleviate the individual shortcomings of each of the UV lamps 60. The two devices 150 and 152 are mounted such that the longitudinal axis 122 of each lamp 60 forms an angle D and E neither substantially parallel nor substantially perpendicular to any of the sides 124, 126, 128, and 130 the air duct 14. As shown in FIG. 8, the longitudinal axis 122 of the UV lamp 60 of the first device 150 is inclined approximately 37 degrees with respect to a horizontal centerline drawn through the air duct 14. Additionally, the longitudinal axis 122 of an UV lamp 60 of the second device 152 is declined approximately 37 degrees with respect to a horizontal centerline drawn through the air duct 14. However, other angles are contemplated and will be recognized by one of ordinary skill in the art to be consistent with the invention as described herein. Specifically, the angles D and E should comport to the configuration of the duct 14 into which the UV devices 150 and 152 are being mounted. For example, as shown in FIG. 8, the two UV devices 150 and 152 may be mounted such that the cross-sectional triangular areas 134 and 136 of the duct 14 that would not be flooded with UV light by the UV lamp 60 of the first device 150 are flooded with UV light by the UV lamp 60 of the second device 152. The UV devices 150 and 152 may otherwise be configured as necessary to increase the area of coverage of UV light within the duct 14.

The preferred size of the UV lamp 60 is determined by the size of the air duct 14 within which a the UV lamp 60 is to be used. It is preferable to install the longest UV lamp 60 that will fit within the air duct 14 to maximize the intensity of the UV light within the duct 14. Once the appropriate size of the UV lamp 60 is determined, then the preferred number of UV devices 10 can be determined. For example, when employing a twelve inch UV lamp 60, it is preferable to use at least one UV device 10 for buildings approximately 1000 square feet in size, at least two UV devices 10 for buildings approximately 1500 square feet in size, at least three UV devices 10 for buildings approximately 2500 square feet in size, and at least four UV devices 10 for buildings approximately 3500 square feet in size. Alternatively, when employing an eighteen inch UV lamp 60, it is preferable to use at least one UV device 10 for buildings approximately 1000 square feet in size, at least two UV devices 10 for buildings approximately 2500 square feet in size, and at least three UV devices 10 for building approximately 3500 square feet in size.

The improved coverage gained by using two angled lamps instead of one straight lamp is shown by the following example. Using a straight-mounted twelve inch UV light bulb within a twelve inch duct results in approximately 83% coverage, using a straight-mounted twelve inch UV light bulb within an eighteen inch duct results in approximately 56% coverage, and using a straight-mounted twelve inch UV light bulb within a twenty-four inch duct results in approximately 42% coverage. By using two twelve inch UV light bulbs mounted at an angle of approximately thirty-seven degrees in each of the ducts above, results in approximately 95% coverage, 76% coverage and 63% coverage, respectively.

As shown in another comparison, comparing the use of a single straight-mounted bulb with the use of two longer angularly-mounted bulbs in the same duct, the coverage area is increased as set forth below. Using a straight-mounted twelve inch UV bulb 60 within a twelve inch square duct 14, as illustrated in FIG. 6, results in approximately 83% coverage. Using a straight-mounted eighteen inch UV bulb 60 within an eighteen inch square duct 14 results in approximately 90% coverage. Using a straight-mounted twenty-four inch UV lamp 60 in a twenty-four inch square duct 14 results in approximately 93% coverage. By comparison, using the configuration of UV devices similar to that shown in FIG. 8, using two fourteen inch UV lamps 60 mounted at approximately thirty-seven degrees within a twelve inch square duct 14 results in approximately at least 98% coverage. Using two twenty-three inch UV lamps 60 mounted at approximately thirty-seven degrees within an eighteen inch square duct 14 results in approximately at least 99% coverage. Finally, using two twenty-eight inch UV lamps 60 mounted at approximately thirty-seven degrees within a twenty-four inch square duct 14 results in approximately at least 99% coverage.

In addition to increasing the cross-sectional area of the air duct 14 flooded with UV light, the configuration of devices 150 and 152 illustrated in FIGS. 8 and 9 increases the volume of the air duct 14 flooded with UV light. As discussed above, the intensity of UV light at any point decreases as the radial distance between the point and an UV lamp 60 increases. Accordingly, increasing the distance C between the two devices 150 and 152 increases the volume of the duct 14 that is flooded in UV light at an intensity capable of controlling the growth of or killing contaminants. Similarly, decreasing the distance C between the two devices 150 and 152 decreases the volume of the duct 14 that is flooded in UV light, but increases the intensity of UV light within the volume the UV light does flood. Therefore, the distance C can be adjusted at the time of installation to best suit the needs of the particular application.

Figure 10:
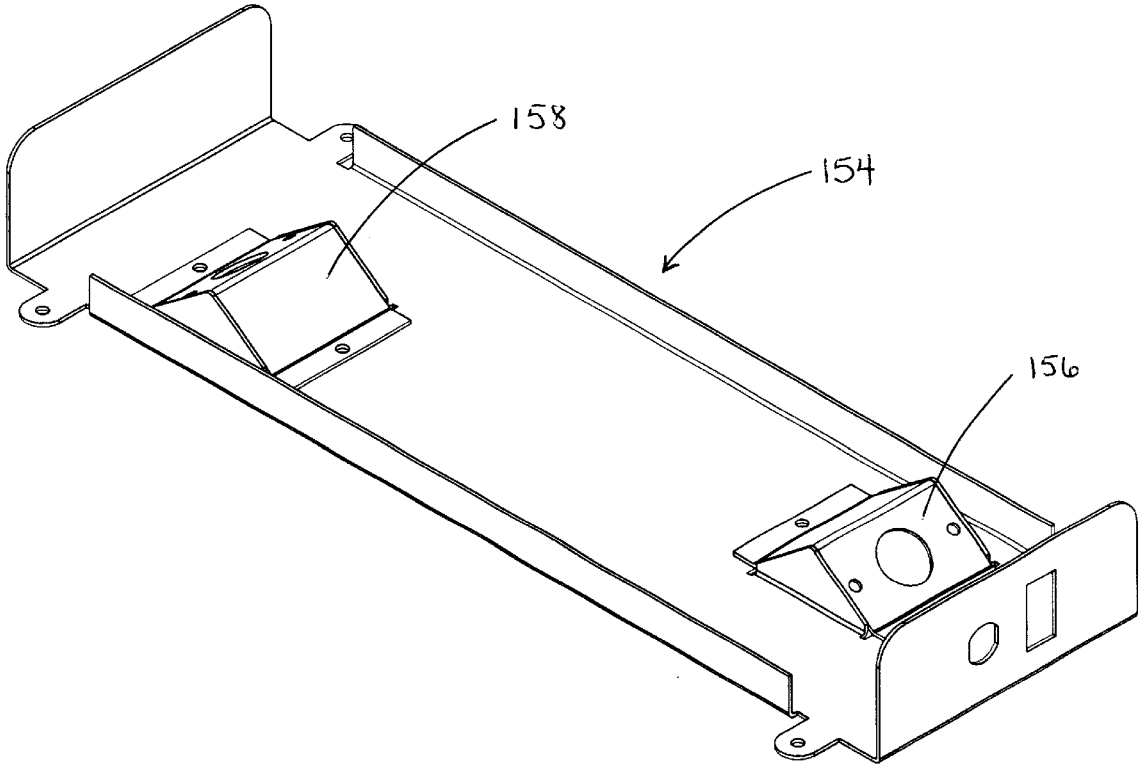
FIG. 10 is a perspective view of another embodiment of the UV device, shown without a cover.

FIG. 10 illustrates a UV device 154, including two angled mounting brackets 156 and 158, for use in applications where implementing a single device 154 to accomplish the mounting configuration illustrated in FIGS. 8 and 9 is preferred. In addition to the two angled mounting brackets 156 and 158 shown in FIG. 10, the UV device 154 may include; an electrical power assembly 40, at least one ballast 56, appropriate electrical wiring, including an AC cord 50, two UV lamps 60, two clamping pieces 82, at least one viewing piece 64, a cover 38, as well as any of other various mounting holes and other parts of the device described above necessary to practice the invention.

The preferred location for mounting the UV device 10 is in the supply duct (not shown) over the air-conditioning ("A/C") coil. This location is downstream of the air filter (not shown), keeping the lamp 60 clean, and also allows the lamp 60 to inhibit contaminant growth in condensation formed on the A/C coil (not shown). Alternatively, the UV device 10 may be installed in the return air duct (not shown), preferably downstream of the air filter, or any other location within the HVAC system. If more than one UV device 10 is to be used in an HVAC system, installation in both the supply and return ducts is preferred for its cumulative effect.

It should be noted that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An ultraviolet device for use with an air duct of an air ventilation system comprising;

a housing;

an ultraviolet light lamp; and a removable bracket assembly for mounting said lamp to said housing, said bracket assembly including an angled mounting bracket and a clamping piece.

2. The ultraviolet device of claim 1 wherein said mounting bracket is configured for mounting said lamp within the air duct at an angle of approximately 37 degrees with respect to the upper and lower walls of the air duct.

3. The ultraviolet device of claim 1 wherein said clamping piece, secures a shoulder of said lamp between said mounting bracket and said clamping piece.

4. The ultraviolet device of claim 1 further comprising a ballast mounted to said housing and coupled to said lamp.

5. The ultraviolet device of claim 4 further comprising an electrical power assembly attached to said housing and coupled to said ballast.

6. The ultraviolet device of claim 5 wherein said electrical power assembly further comprises a switch for enabling and disabling the supply of electricity to said ballast.

7. The ultraviolet device of claim 1 further comprising a viewing piece having a first end and a second end attached to said mounting portion wherein said viewing piece allows an operator to look into said first end of said viewing piece, through said second end of said viewing piece, to view the interior of the air duct to which said device is mounted.

8. The ultraviolet device of claim 7 wherein said viewing piece further comprises an elongated hollow cylinder.

9. The ultraviolet device of claim 7 wherein said viewing piece further comprises a lens mounted to said first end of said viewing piece to reduce the amount of ultraviolet light that can escape through said viewing piece.

10. The ultraviolet device of claim 1 further comprising a cover, said cover being mountable to said housing.

11. An ultraviolet device for use with an air duct of an air ventilation system comprising;

an ultraviolet lamp; and a mounting bracket assembly including an angled mounting bracket and a removable clamping piece, whereby said mounting bracket assembly secures said lamp to the air duct such that the lamp is positioned within the air duct.

12. The ultraviolet device of claim 11 wherein said mounting bracket is configured for mounting said lamp within the air duct at an angle of approximately 37 degrees with respect to the upper and lower walls of the air duct.

13. The ultraviolet device of claim 11 further comprising a ballast mounted to said mounting bracket assembly and coupled to said lamp.

14. The ultraviolet device of claim 13 further comprising an electrical power assembly attached to said mounting bracket assembly and coupled to said ballast.

15. The ultraviolet device of claim 11 further comprising a viewing piece having a first end and a second end attached to said mounting bracket assembly, wherein said viewing piece has an aperture extending from said first end through said second end allowing an operator to look into the interior of the air duct.

16. The ultraviolet device of claim 15 wherein said viewing piece further comprises a lens mounted to said viewing piece such that said lens reduces the amount of ultraviolet light that can escape through said viewing piece.

17. An ultraviolet device for use with an air duct of an air ventilation system comprising;

an ultraviolet lamp; and a mounting bracket assembly including an angled mounting bracket and a removable clamping piece.

* * * * *